US010470598B1

(12) United States Patent
Abbisso et al.

(10) Patent No.: US 10,470,598 B1
(45) Date of Patent: Nov. 12, 2019

(54) SAFETY LIDS FOR CUPS

(71) Applicants: Leonard J Abbisso, Dedham, MA (US); Joanne Toomey, Dedham, MA (US)

(72) Inventors: Leonard J Abbisso, Dedham, MA (US); Joanne Toomey, Dedham, MA (US)

( * ) Notice: Subject to any disclaimer, the term of this patent is extended or adjusted under 35 U.S.C. 154(b) by 247 days.

(21) Appl. No.: 15/492,018

(22) Filed: Apr. 20, 2017

Related U.S. Application Data

(60) Provisional application No. 62/392,206, filed on May 24, 2016.

(51) Int. Cl.

| | |
|---|---|
| ***A47G 19/22*** | (2006.01) |
| ***B65D 47/32*** | (2006.01) |
| ***B65D 47/06*** | (2006.01) |
| ***B65D 43/02*** | (2006.01) |

(52) U.S. Cl.
CPC ..... *A47G 19/2272* (2013.01); *B65D 43/0214* (2013.01); *B65D 47/06* (2013.01); *B65D 47/32* (2013.01); *B65D 2543/00046* (2013.01)

(58) Field of Classification Search
CPC ..... A47G 19/2272; B65D 43/02; B65D 43/0214; B65D 47/06; B65D 47/32; B65D 2543/00046; B65D 2205/02; B65D 45/322
USPC ..... 220/713, 717, 367.1, 319; 229/906.1; 215/274
See application file for complete search history.

(56) References Cited

U.S. PATENT DOCUMENTS

| | | | | |
|---|---|---|---|---|
| 5,645,191 | A | 7/1997 | Neville | |
| 5,820,016 | A | 10/1998 | Stropkay | |
| 6,523,712 | B1 | 2/2003 | McGushion | |
| 6,578,726 | B1 * | 6/2003 | Schaefer | B65D 47/265 215/387 |
| 7,959,029 | B2 | 6/2011 | Whitaker et al. | |
| 9,113,733 | B2 | 8/2015 | Wu | |
| 2002/0167989 | A1 | 11/2002 | Russo | |
| 2005/0242096 | A1 | 11/2005 | Jaghab | |
| 2006/0096983 | A1 * | 5/2006 | Patterson | B65D 47/265 220/253 |
| 2007/0251948 | A1 * | 11/2007 | Baker | B65D 43/0212 220/712 |
| 2009/0108903 | A1 | 4/2009 | Tripsianes | |
| 2009/0283526 | A1 * | 11/2009 | Pierce | A47G 19/22 220/254.7 |
| 2010/0187247 | A1 * | 7/2010 | Ziegler | A47G 23/0233 220/783 |
| 2011/0309093 | A1 * | 12/2011 | Buck | A47G 19/2205 220/711 |

(Continued)

*Primary Examiner* — Andrew T Kirsch
*Assistant Examiner* — Elizabeth J Volz
(74) *Attorney, Agent, or Firm* — Stan Collier, Esq

(57) ABSTRACT

The safety lid can be used on cups. The lid has an outer wall and a flat roof near the outer wall. A red line is placed on the lower outer wall and on the outer edge of the roof. The outer wall and a safety ring thereon will have at least one or more complementary dents/indents. The safety ring is L-shaped and fits closely about the outer wall and roof. In order to secure the safety lid, the ring is pressed downward onto the lid on the cup. The red line on the roof of the lid is covered by the short leg of the L-shaped safety ring and the red line on the lower outer wall is covered by a lower wall section of the safety ring. Locking flaps or triangles may also be included to engage the cup.

5 Claims, 5 Drawing Sheets

(56) References Cited

U.S. PATENT DOCUMENTS

| | | | |
|---|---|---|---|
| 2015/0144646 | A1 | 5/2015 | Savenok |
| 2015/0191282 | A1 | 7/2015 | Crudgington |

* cited by examiner

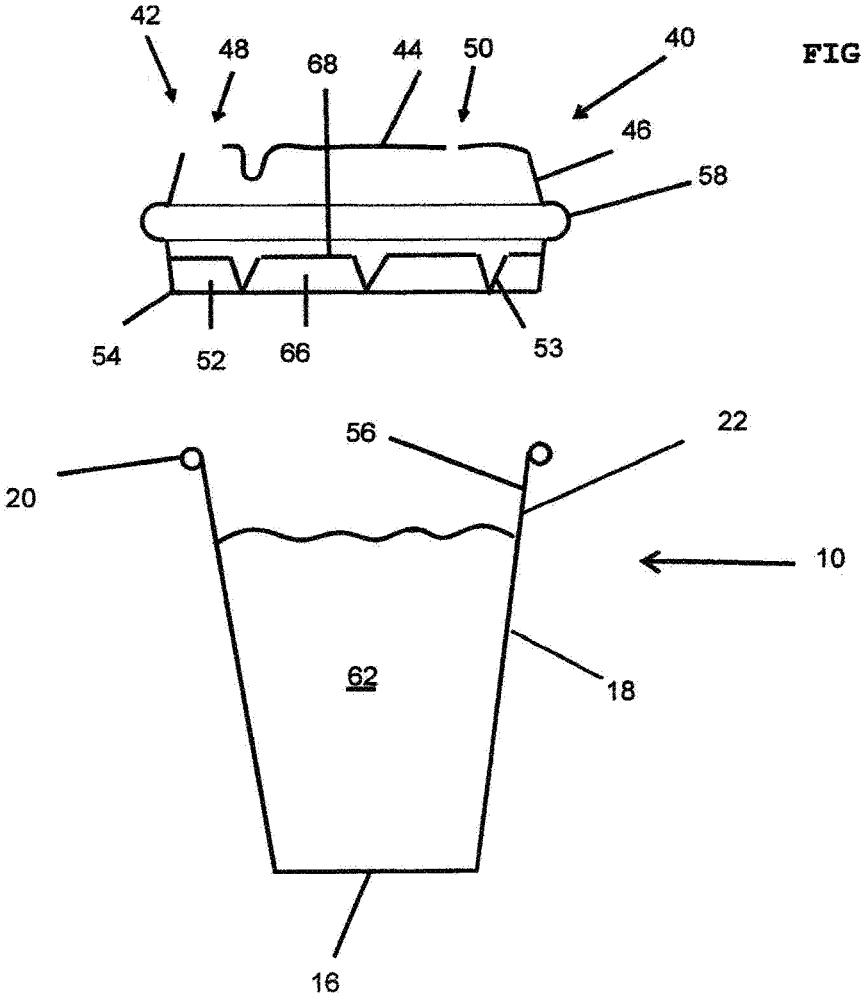
FIG. 2A
FIG. 2B
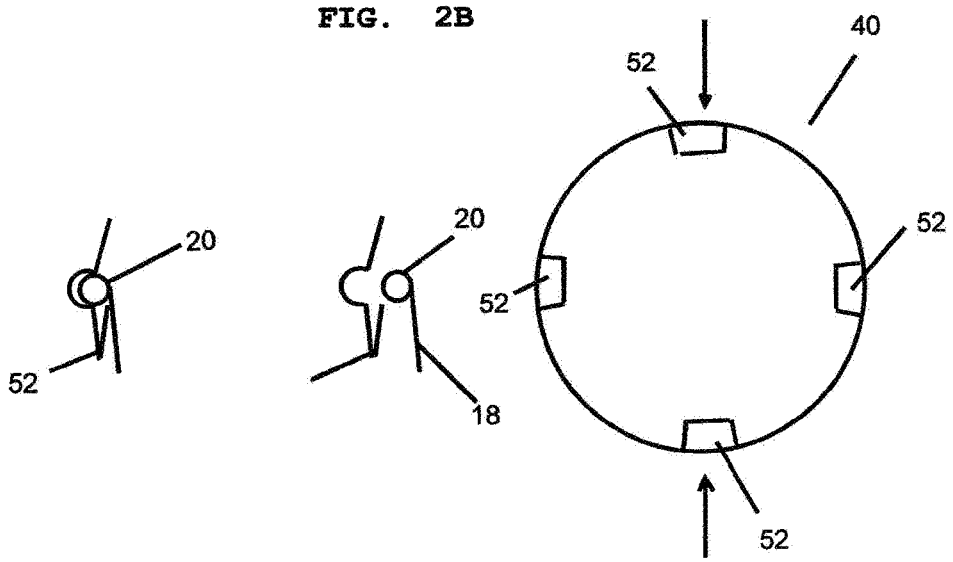

SAFETY LIDS FOR CUPS

CROSS REFERENCES TO RELATED APPLICATIONS

The is the regular filing from provisional patent application entitled, "Safety Lids for Cups." filed May 24, 2016 by inventors, Leonard J. Abbisso and Joanne Toomey with Ser. No. 62/392,206.

REFERENCE TO FEDERALLY SPONSORED RESEARCH OR DEVELOPMENT

NA

REFERENCE TO JOINT RESEARCH AGREEMENTS

NA

REFERENCE TO SEQUENCE LISTING

NA

BACKGROUND OF THE INVENTION

Field of the Invention

The present invention relates generally to cups for holding fluids that are typically used in fast food restaurants, and, more particularly, relates to the lids used on these cups, and, in greater particularity, relates to safety lids for use on these cups to prevent spilling of the fluids therein.

Description of the Prior Art

The use of disposable cups at, in particular, fast food restaurants is wide spread. Cups would hold hot or cold drinks, and even soups. These cups are typically paper or plastic or styrofoam, conically shaped, and usually have plastic lids with a drinking hole that may include an openable door and an air hole. The lids are normally secured to the cup by a channel on the outside inner edge of the lid that fits very closely to the top of the cup that normally has a ridge/edge thereabout. The lid is pressed onto the edge. Unfortunately, the lid may not be totally secured thereon resulting in the lid coming off when the cup is lifted by the lid or when the cup falls over. The liquids therein may be quite hot and thus result in injury.

One of the prior art references that addresses this problem is from Smart Lid Systems. A coloring changing chemical is incorporated into the lid: too hot, it shows red; normal drinking temperature, it shows brown. About the lid channel, the chemical will indicate if the lid is not attached or only attached in some sections by turning red when the hot coffee fumes escape. If the coffee has cooled, only brown will be shown and thus the lid may not be properly attached. Also see article titled, "Coffee cup" on Wikipedia as a general background to cups.

Several U.S. patents and patent publication applications address the problem of securing the lids to the cups such as: U.S. Pat. No. 9,113,733 that shows a cup lid having an outer wall and a roof thereon, but slanted near the drinking orifice. U.S. Pat. No. 7,959,029 shows a splash and spill resistant insulating lid. An outer wall and a roof thereon are shown. U.S. Pat. No. 6,523,712 shows a lid having a spill blocking spout. U.S. Pat. No. 5,820,016 shows a coffee cup and lid with a positive locking feature included being shown as ring 40 and the lid 28 and a groove 24 on the cup to accept the ring 40 when pushed down. U.S. Patent Application Publication 2015/0191282 shows a lid having a flat outer circumference wall and a roof thereon. U.S. Patent Application Publication 2015/0144646 shows a lid having a lid-to-wall locking structure to lock the lid to the cup. U.S. Patent Application Publication 2011/0309093 shows a lid having two containment volumes in the top. U.S. Patent Application Publication 2009/0108003 shows a lid having a temporary storage volume therein such as '093 above. U.S. Patent Application Publication 2005/0242096 shows a lid having a flat outer circumference wall and a roof thereon. U.S. Patent Application Publication 2002/0167989 shows a lid having a temperature indicating means thereon. All references are incorporated herein as to their teachings.

Accordingly, there is a need for a device providing secure locking lid that prevents spills.

SUMMARY OF THE INVENTION

The safety lid invention is directed at, in particular, coffee cups having hot coffee or other hot liquids therein, or cups for holding cold fluids and even soups The cups may be plastic, paper or Styrofoam. Typically a conventional plastic lid has an outer channel open on the inner edge and that is press fitted over the lip of the coffee cup. Due to rapid preparation, the worker can fail to properly attach the lid. The user may grab the coffee cup by the lid and it will come off and spill the hot coffee. Also, during drinking, the lid may dislodge and also spill the hot coffee. It is thus important to know if the lid is properly attached.

The invention can be used on a plastic lid. The lid will have an outer circumference wall and a flat roof thereon in addition to the other lid features. A red circular line will be placed on the outer wall and on the roof's outer edge. The red line may be segmented. A safety ring is L-shaped and fits closely about the outer wall and roof thereon and will have sections that will cover the red lines when properly installed on the lid. The outer wall will have at least one or more protruding bumps, or similar features such as indents. The safety ring would have at least one or more similar complementary features to provide a tactile feel as the lid is installed. In order to secure the safety ring, the worker must press the ring down over the bumps so that the red line on the outer wall is not showing. Further, when properly pressed on, the red line on the roof is covered by the short leg section of the L-shaped ring. The amount of force used to press on the ring will be designed to insure that the lid channel is secured to the top edge of the cup. Further, no red lines, either on the outer wall or on the roof will be showing. Thus the customer and worker by visual observations can verify that the lid is properly installed.

It is an object of the present invention to provide a means for preventing spilling of liquids from a cup, either plastic or paper or styrofoam.

It is another object of the present invention to provide a means for more effectively securing the lid.

It is a further object of the present invention to provide a means for visually checking to insure that the lid is properly secured on the cup.

It is still a further object of the present invention to provide a device having means for better securing the lid to the edge.

It is still another object of the present invention to provide a safety ring about the lid to accomplish the above objectives.

These and other objects, features, and advantages of the present invention will become more readily apparent from the attached drawings and the detailed description of the preferred embodiments which follow.

BRIEF DESCRIPTION OF THE DRAWINGS

FIG. 2A is a cross-sectional view of a first embodiment of the present invention having a locking V-flap on a bottom edge of a lid facing inward positioned over a cup. FIG. 2B is a bottom view of the lid showing the locking V-flaps;

Like reference numerals refer to like parts throughout the several views of the drawings.

DETAILED DESCRIPTION OF THE PREFERRED EMBODIMENTS

Having a lid come off accidentally on a coffee cup with hot coffee therein can spell disaster. The hot fluid can burn skin, damage car flooring and upholstery, damage clothes, cause the driver to look away from driving, etc. Almost every cup of coffee served through a pickup window has a lid. Cups having cold fluids would be similarly protected. But the real question is is whether the lid is securely attached.

Figure 1A:
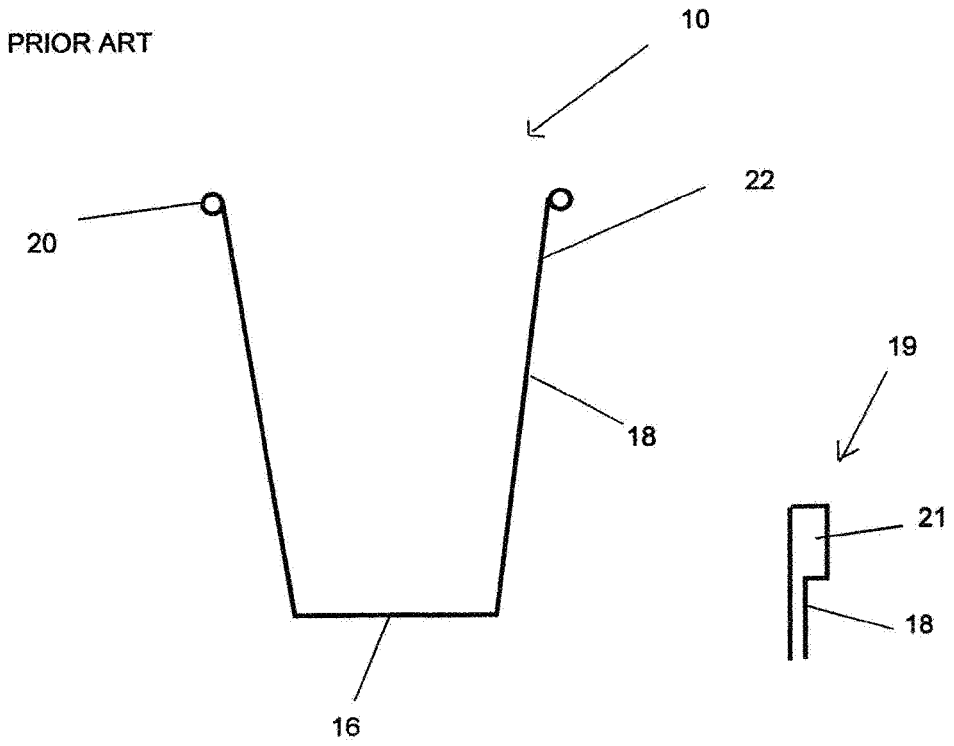
FIG. 1A is a prospective view of a prior art paper cup with a prior art plastic lid.
Figure 1B:
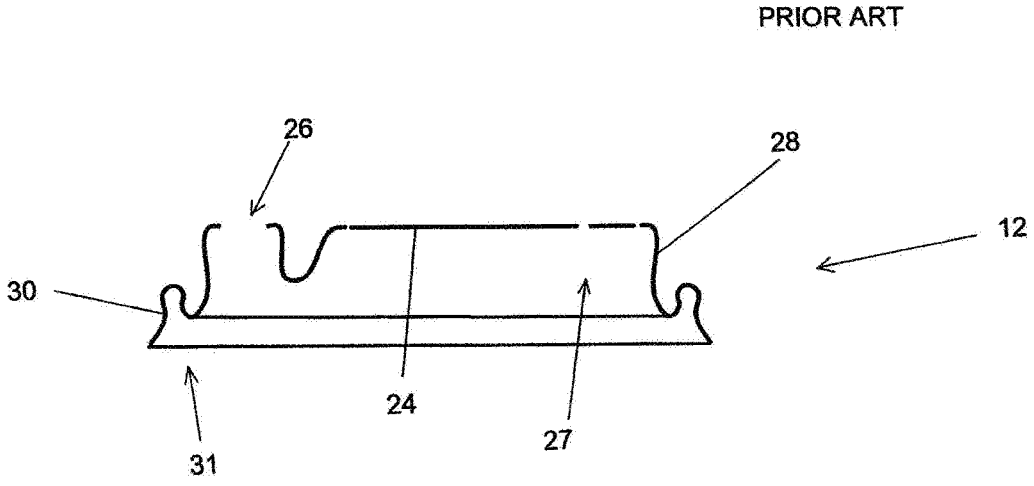
FIG. 1B is a cross-section of a prior art lid. A Styrofoam edge of a styrofoam cup is also shown in FIG. 1A.

FIG. 1A is a cross-sectional view of a conventional cup 10 with a prior art lid 12 in FIG. 1B such as the SOLO Traveler Lid, TLP 316. The cup 10 has a bottom 16, a truncated conical wall 18 with a lip or bead 20 on the upper edge 22. A Styrofoam edge 19 is partially shown being essentially a rectangular section 21 on the wall 18. In FIG. 1B, the lid 12 has an upper surface 24, a drinking device 26 and an air vent 27, an outer wall 28, a lip 30, and a bead holding channel 31. A plastic door, not shown, may be used to seal the drinking device until it is removed or the drinking device may be an open hole and the air vent may be one or more holes in the lid such as shown. By design the lip channel 31 fits closely about the bead 20 when pushed on, but there is no indication whether, in fact, the lid 12 is properly installed on the cup 10. By design, when the lip 30 is properly connected to the bead 20, the lid 12 will normally remain thereon if the cup is tilted over. Whether it will remain thereon if the user grabs the lip 30 or drops it is the major issue. The cup 10 may be made of plastic or paper or styrofoam, and if paper, the bead 20 will be formed thereon. A cup made of Styrofoam may have a thickened upper wall 22, but not a bead thereon. All of the conventional cups and lids are of circular design and the features thereon are all well known to one skilled in the art. All depictions herein are by cross-section unless otherwise stated and further are of circular objects unless also stated. The portions shown are not intended to be accurate in that the lid 12 will not fit on cup 10 as drawn and are merely for illustrating the present invention.

Figure 3:
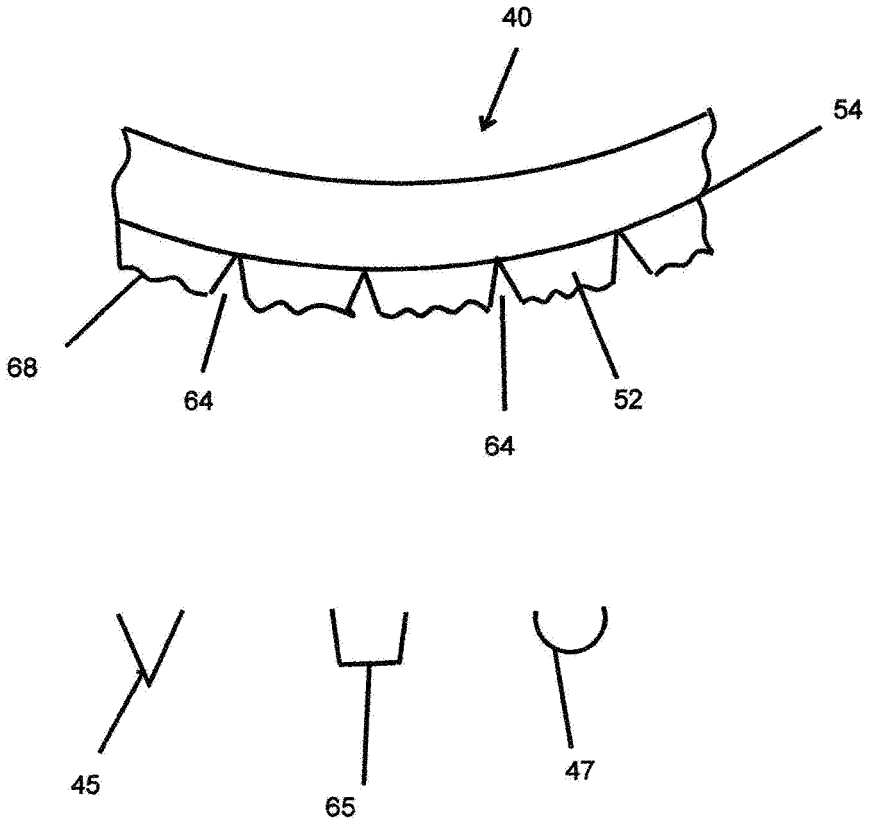
FIG. 3 is a bottom view of a segmented locking flap with serrated edges with different flaps shown thereunder.

Referring to FIG. 2A, the first embodiment of the present invention is shown by cross-section. A safety lid 40 is shown directly above the cup 10 having a bead 20 thereon. The bead 20 is formed integrally with the cup 10 and projects outwardly about ⅛ inch from the wall 18 and is about ⅛ inch in diameter. The bead 20 is typically formed by rolling tightly the wall 22 into a circular bead 20. The safety lid 40 for the cup 10 comprises a plastic lid 42 with a top surface 44 and a wall 46 about the top surface 44 integrally formed as one piece. The top surface 44 has formed therein a drinking device 48 and an air hole 50. The drinking device 48 and the air hole 50 may form one device in the plastic cover that is removed or opened by the user when drinking. A combined drinking device and air hole device prevents minor leakage from the air hole when the cup is tilted. A plastic doorway, not shown, may be pushed opened and be hinged to the surface 44. At least one locking V-flap 52 is attached at a bottom edge 54 on the wall 46. The locking V-flap 52 is flexible and segmented as shown by break lines 53 and the locking V-flaps 52 engage the bead 20 on the cup upper edge 56 when connected to the cup 10. At least one indent 58 is located above the locking V-flap 52 on the interior surface 62 of the wall 46 and allows the bead 20 to rest therein. The indent 58 closely fits over the bead 20 of the cup 10 when properly attached. The lid 40 once installed is substantially difficult to remove so as to prevent spilling of fluids 62 in the cup 10 when used. The safety lid 40 has the locking V-flap 52 in a V-shape directly under the bead 20 when properly installed. See FIG. 2B. The locking V-flap 52 is an integral part of the lid 40, and is about the wall in the preferred embodiment, but may have spaces 64 therebetween in FIG. 3. The flexible flap 66 is on the interior side of the wall 46 and has its upper edge 68 pointing upward on the inside. Further the upper edge 68 may be serrated so as to grip Stryofoam also. Although the locking flap 52 is seen as a flap, it may have other shapes such as square or rectangle 65, FIG. 3, or a half ellipse or circle 47, or triangle 45. FIG. 3 is a view from the inside of the lid 40 looking down into the locking V-flap 52. This embodiment would secure the safety lid to a Styrofoam cup since the flaps 66 and those shown in FIG. 3 would "dig" into the Styrofoam material in the direction of removal. FIG. 2B shows one method of removal of the lid 40. The lid 40 has four locking V-flaps 52 equally spaced about the lid 40. When properly installed, the locking V-flap 52 goes under the bead 20 as shown. To remove, one squeezes on opposite sides of the lid 40 as indicated by the arrows. The adjacent locking V-flap 52 is then moved away from the bead 20. The lid 40 may thus be removed.

When the safety lid 40 is installed, the locking flap 52 bends outward as the lid 40 is being pushed on the cup 22, away from the center of the cup, and passes over the bead 20 until the flap 66 top edge 68 clears the bottom of the bead 20 and then snaps under the bead 20 thus making the removal of the lid 40 difficult and thus insuring a safety lid as called for in the present invention.

Figure 4:
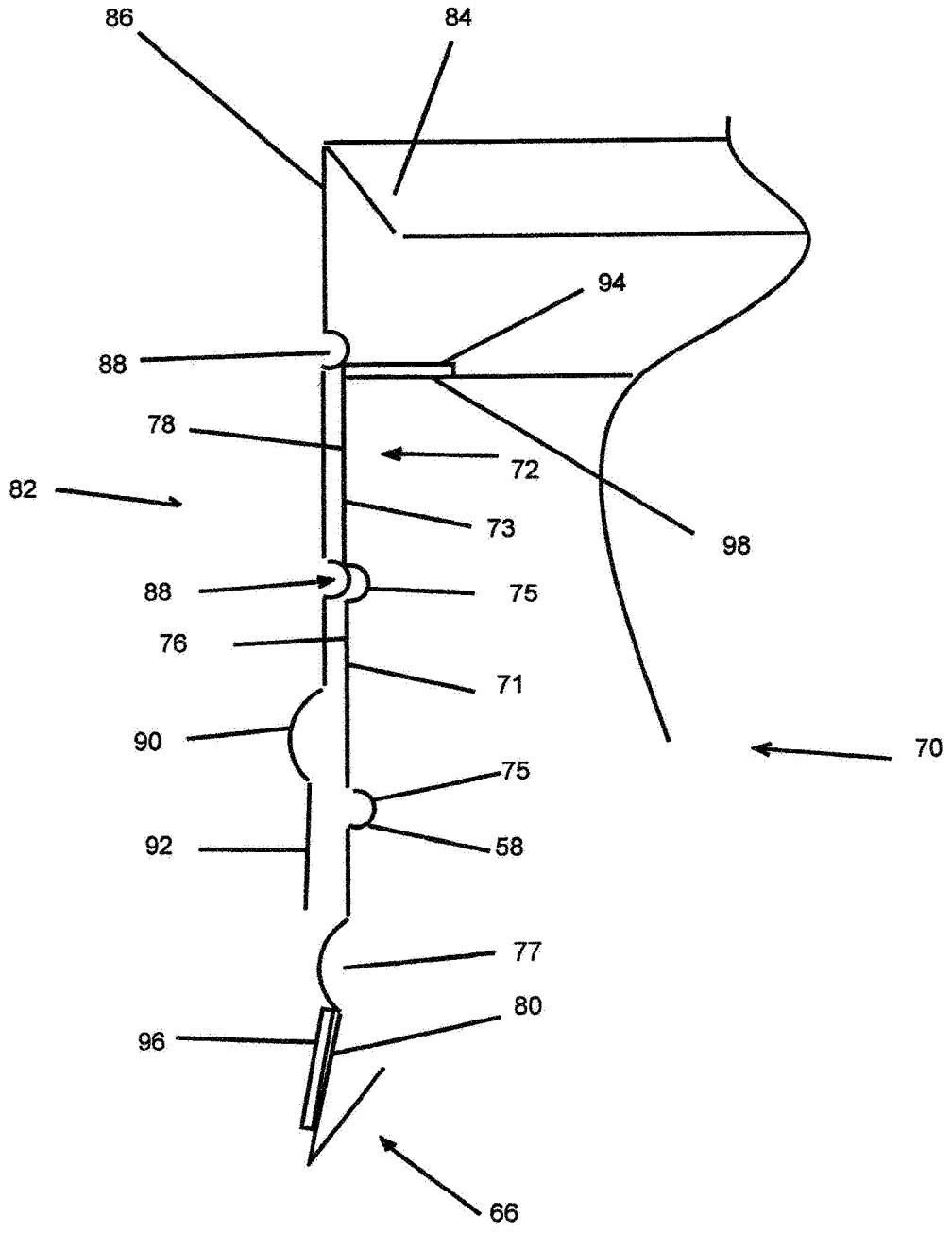
FIG. 4 is a cross-section view of a locking lid with a safety ring thereon with locking V-tabs/flaps.

Looking at FIG. 4, another embodiment of a safety lid 70 is shown in cross-section and is similar to the lid 40 unless noted differently hereinbelow. The safety lid body 71 comprises at least one indent 75 (two indents are shown) about an interior surface 73 of the wall 72 that will fit over the bead 20 when properly attached. Further indents 75 may be one or more grooves/channels/or similar means on the exterior surface 76 of the wall 78 and may be further segmented. In FIG. 4, two indents 75 are shown. Below the lower indent 58 is a bead channel 77 that may be an indent where that will hold the bead 20 when inserted into the safety lid 70. An extended wall section 80 being about ⅛ to 3⁄16 inches long is slanted away from the center vertical line of the cup. This allows the extended wall section 80 to better fit over the bead 20 when installed. The extended wall section 80 may also be a leg of a locking flap 66 in this embodiment.

Further, the safety lid 70 includes a safety ring 82 that moves vertically on the safety lid body 71. The safety ring 82 has an upper flap 84 which may be segmental also that is hinged to a safety ring wall 86. The safety ring wall 86 includes one or more inward dents 88 that fit into the indents 74 as the safety ring wall 86 is moved downward. The lower dent 88 may rest in the upper indent 75 before installation. Below the inward dents 88 is a curved section 90 that fits over the bead channel t 77. Below the curved section 90 is a ring extension wall 92 that points essentially downward. Further the lid body 71 includes an upper colored strip 94 and a lowered colored strip 96. The first or upper colored strip 94 is located on an outer edge 98 of the top surface of the safety lid body 71; the second or lowered colored strip 96 is located on the extended wall section 80. When the lid 70 is properly installed, ie, pushed downward, the upper colored strip 94 will be covered by the upper flap 84 being a flexible lip, and the ring extension wall 92 will cover the second or lower colored strip 96. The ring extension wall 92 will further push the extension wall section 80 inward to further aid in securing the lid to the bead 20. As seen, the extended wall section 80 may be a part of the locking flap 66. It is clearly possible to remove the locking flap 66 to reduce manufacturing costs and still retain the safety locking feature where no colored strips 84/96 will be seen when properly installed. Preferably, the colored strip is red and thus when red is seen, the safety lid is not properly installed.

Figure 5:
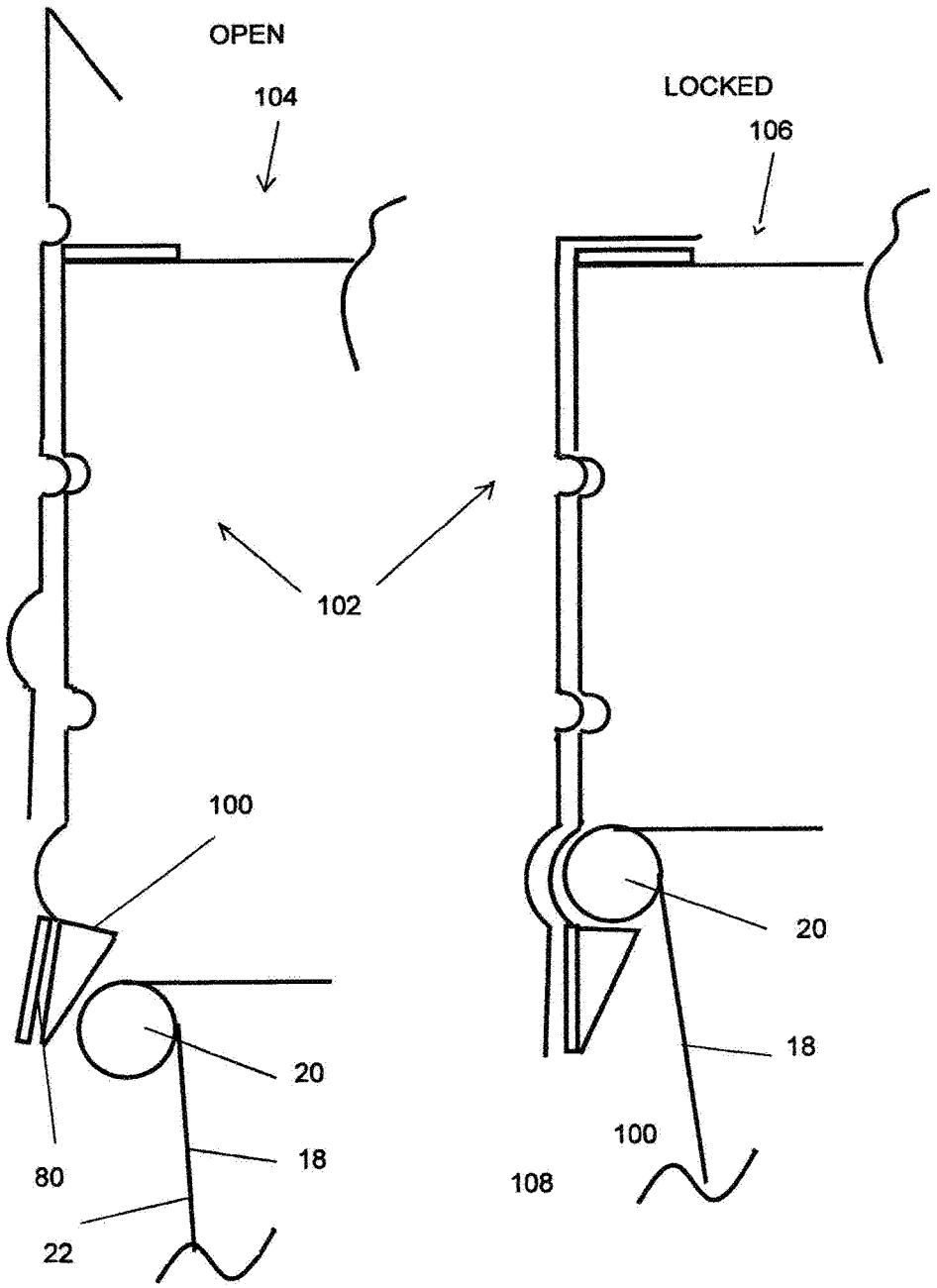
FIG. 5 is a cross-section view of a locking lid with a safety ring thereon and with a locking triangle thereunder in an open and locked positions.

FIG. 5 illustrates another embodiment where the locking flap 66 of FIG. 4 is replaced by a locking triangle 100. FIG. 5 illustrates the safety lid 102 in an open condition 104 and a closed position 106 where the locking triangle 100 goes under the bead 20 when in the closed position. The locking triangle 100 is located on the bottom edge 108 of the wall extended wall section 80. The locking triangle 100 being flexible engages the bead 20 when connected to the cup properly where the colored strips, being red preferably, are covered to indicate that the lid is properly installed. The locking triangle 100 may be continuous about the bottom edge of the wall or segmented to aid in bending. As seen and described, the safety ring of the present invention is able to be positioned on the outer surface of the wall of the lid by friction fit or by tactile feel between the indents and dents. Also, the safety ring is able to be positioned on the outer surface of the wall with complementary dents/indents whereby the safety ring is held by the temporary engagement of the dents to indents. The colored strips are circular in shape, and may be at least one or more sections thereabout. Preferably, the colored strips are red.

Since many modifications, variations, and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A safety lid for a cup, said safety lid comprising:

a plastic lid, said plastic lid having a top surface and a lid wall about the top surface, said lid wall having a diameter that closely fits on the cup, the cup having a bead about its top edge wherein when said lid is pushed onto the cup, said lid being substantially difficult to remove so as to prevent spilling of fluids in the cup when used, at least one indent about an interior surface of the wall, said indent closely fitting over said bead of the cup when properly attached;

a drinking device in said top surface, an air device in said top surface, a safety ring, said safety ring further securing said plastic lid to the cup, further including a flexible lip integrally attached to the upper edge of said safety ring, said flexible lip being located on the inside of said safety ring, said flexible lip and said safety ring wall forming a V-shaped lip.

2. A safety lid for a cup, said safety lid comprising: a plastic lid, said plastic lid having a top surface and a lid wall about the top surface, said lid wall having a diameter that closely fits on the cup, the cup having a bead about its top edge wherein when said lid is pushed onto the cup, said lid being substantially difficult to remove so as to prevent spilling of fluids in the cup when used; at least one indent about an interior surface of the wall, said indent closely fitting over said bead of the cup when properly attached, a safety ring, said safety ring further securing said plastic lid to the cup, further including a flexible lip integrally attached to the upper edge of said safety ring, said flexible lip being located on the inside of said safety ring, said flexible lip and said safety ring wall forming a V-shaped lip; further including a pair of colored strips, a first or upper strip being located on an outer edge of said top surface of said safety lid, a second or lower strip being located on an outside of an extended wall section on a lower wall of said safety lid, said colored strips being covered by said flexible lip and said lower curved section when said safety ring of said safety lid is properly installed on said cup, and having a drinking device in said top surface, an air device in said top surface.

3. A safety lid for a cup, said safety lid comprising:

a plastic lid, said plastic lid having a top surface and a lid wall about the top surface, said lid wall having a diameter that closely fits on the cup, the cup having a bead about its top edge wherein when said lid is pushed onto the cup, said lid being substantially difficult to remove so as to prevent spilling of fluids in the cup when used, at least one indent about an interior surface of the wall, said indent closely fitting over said bead of the cup when properly attached;

a drinking device in said top surface, an air device in said top surface, and a safety ring, said safety ring further securing said plastic lid to the cup, further said safety ring is able to be positioned on an outer surface of said lid wall, said safety ring and said lid wall having complementary dents and indents whereby the safety ring is held by the temporary engagement of said dents and indents and provides a tactile feel when being installed, wherein said dents and indents are continuous about said locking ring and said lid wall, respectively, wherein a lower curved section of said lid is flexed outwardly of said safety ring, and engages the bead of the cup when pushed downward by said safety ring.

4. A safety lid for a cup, said safety lid comprising: a plastic lid, said plastic lid having a top surface and a lid wall about the top surface, said lid wall having a diameter that closely fits on the cup, the cup having a bead about its top edge wherein when said lid is pushed onto the cup, said lid being substantially difficult to remove so as to prevent spilling of fluids in the cup when used; a safety ring, said safety ring further securing said plastic lid to the cup, further including a flexible lip integrally attached to the upper edge of said safety ring, said flexible lip being located on the inside of said safety ring, said flexible lip and said safety ring wall forming a V-shaped lip; further including a pair of colored strips, a first or upper strip being located on an outer edge of said top surface of said safety lid, a second or lower strip being located on an outside of an extended wall section on a lower wall of said safety lid, said colored strips being covered by said flexible lip and said lower curved section when said safety ring of said safety lid is properly installed on said cup, wherein said colored strips are circular in shape, at least one or more of said colored strips are partial circles thereabout, at least one indent about an interior surface of the wall, said indent closely fitting over said bead of the cup when properly attached; a drinking device in said top surface, an air device in said top surface.

5. A safety lid for a cup, said safety lid comprising: a plastic lid, said plastic lid having a top surface and a lid wall about the top surface, said lid wall having a diameter that closely fits on the cup, the cup having a bead about its top edge wherein when said lid is pushed onto the cup, said lid being substantially difficult to remove so as to prevent spilling of fluids in the cup when used; at least one indent about an interior surface of the wall, said indent closely fitting over a bead of the cup when properly attached, a safety ring, said safety ring further securing said plastic lid to the cup, further including a flexible lip integrally attached to the upper edge of said safety ring, said flexible lip being located on the inside of said safety ring, said flexible lip and said safety ring wall forming a V-shaped lip; further including a pair of colored strips, a first or upper strip being located on an outer edge of said top surface of said safety lid, a second or lower strip being located on an outside of an extended wall section on a lower wall of said safety lid, said colored strips being covered by said flexible lip and said lower curved section when a safety ring of said safety lid is properly installed on said cup, wherein said colored strips are red; including a drinking device in said top surface, an air device in said top surface.

* * * * *